United States Patent [19]

Brown et al.

[11] Patent Number: 4,632,458

[45] Date of Patent: Dec. 30, 1986

[54] CHAIR BACK HEIGHT ADJUSTMENT MECHANISM

[75] Inventors: Jerry C. Brown, Lenexa; Kenneth W. Hamilton, Overland Park, both of Kans.

[73] Assignee: Fixtures Manufacturing Corporation, Kansas City, Mo.

[21] Appl. No.: 736,294

[22] Filed: May 20, 1985

[51] Int. Cl.[4] ..... A47C 1/00; F16M 11/00

[52] U.S. Cl. ..... 297/353; 248/422; 248/404

[58] Field of Search ..... 297/353, 330, 410, 345, 297/347, 348; 108/147; 248/295.1, 422, 404

[56] References Cited

U.S. PATENT DOCUMENTS

| | | | |
|---|---|---|---|
| 1,111,685 | 9/1914 | Allison . | |
| 2,239,732 | 4/1941 | Newhardt . | |
| 2,509,102 | 5/1950 | Kuebler | 297/353 |
| 4,154,477 | 5/1979 | Swenson et al. . | |
| 4,181,357 | 1/1980 | Swenson et al. . | |
| 4,451,084 | 5/1984 | Seeley | 297/353 |

FOREIGN PATENT DOCUMENTS

| | | | |
|---|---|---|---|
| 2926759 | 1/1981 | Fed. Rep. of Germany | 248/422 |
| 19842 | of 1889 | United Kingdom | 248/422 |
| 3181 | of 1891 | United Kingdom | 108/147 |

OTHER PUBLICATIONS

Brochure, Fixtures Furniture, 1983.

*Primary Examiner*—William E. Lyddane
*Assistant Examiner*—Mark W. Binder
*Attorney, Agent, or Firm*—Litman, Day & McMahon

[57] ABSTRACT

A chair back height adjustment mechanism for a chair having a chair back supporting standard and a chair back bracket with a chair back or backrest mounted thereon includes a rack gear on the chair back standard, a pinion gear supported in a bearing on the chair back bracket, a worm gear coaxial with the pinion gear, and worm threads on a dial shaft supported on the bracket. Rotation of the dial causes the worm member to rotate the worm gear and the pinion gear whereby the bracket supporting the pinion gear is translated in relation to the chair back standard. The chair back can only be adjusted by operation of the dial due to the nature of the worm and worm gear combination, thus preventing changes in the adjusted position of the chair back by contact with the chair back.

6 Claims, 6 Drawing Figures

CHAIR BACK HEIGHT ADJUSTMENT MECHANISM

FIELD OF THE INVENTION

The present invention relates to adjustable seating and, more particularly, to chair back height adjustment mechanisms.

BACKGROUND OF THE INVENTION

Many specialized types of seating furniture benefit from adjustability of their parts to conform to the particular size of the individual sitting on such furniture. Components of adjustable office chairs are usually adjusted by a knob which controls a frictional clamping relationship between a first member and a second member. Such measures work well enough in most circumstances. However, with the growing effort to employ disabled persons, there arise situations where a worker is unable to satisfactorily adjust an otherwise serviceable chair because of the level of physical strength required. Therefore, a chair adjustment mechanism which has a high "mechanical advantage" would be useful to facilitate the use of such chairs by all types of workers.

Chairs adapted for professions such as dentistry, certain kinds of medicine, barbering, cosmetology, and other fields have employed geared and powered mechanisms for adjusting the various components thereof. Such mechanisms are usually built heavily for increased durability. The mechanisms are also generally complex, relatively large, and expensive, as are the chairs. Such professional chairs are usually fixed, that is, connected to a floor. Office chairs, on the other hand, are usually mobile, having casters thereon, for greater flexibility of use. Improvements in the adjustment mechanisms of office chairs should not increase their weight significantly, particularly if such chairs are to be used by the disabled. In addition, such improvements should not increase the expense of such office chairs significantly or there is decreased incentive to procure such equipment. The chair adjustment mechanisms which are known in the field of professional type chairs are not necessarily directly applicable to relatively economical, light office chairs because of the weight, size, and expense of such mechanisms.

SUMMARY OF THE INVENTION

The present invention provides a chair adjustment mechanism which has a high mechanical advantage and which is light, compact, and inexpensive. A chair back height adjustment mechanism according to the present invention includes a rack and pinion gear set between a chair back support post or standard and a chair back support bracket on which the chair back or backrest member is mounted. A worm and worm gear set operatively connects between the rack and pinion and a chair back height adjustment dial or knob. The worm gear arrangement limits the manner in which the chair back height can be adjusted. In other words, the position of the chair back member cannot be varied by a force on the chair back itself. Adjustments can only be made by rotation of the knob. The gear ratios of the gear members are designed to balance between the level of strength required to rotate the knob and the speed at which the adjustment can be made.

OBJECTS OF THE INVENTION

The principal objects of the present invention are: to provide an improved chair component adjustment mechanism; to provide, particularly, a chair back height adjustment mechanism; to provide such a mechanism which only requires minimal physical or manual strength and dexterity to operate; to provide such a mechanism wherein the height of the chair back is adjusted by the rotation of a dial or knob; to provide such a mechanism wherein the chair back height can only be adjusted by use of such a dial; to provide such a mechanism which is applicable to an office type chair on which the chair back member is supported by a single post or standard; to provide such a mechanism including worm threads on the dial shaft meshing with a worm gear, the worm gear having a pinion gear coaxial therewith which meshes with a rack gear on a chair back standard on which a chair back support bracket is slidable; to provide such a mechanism which is compact and light in weight; to provide such a mechanism which lends itself easily to a motorized adaptation; and to provide such a mechanism which is economical to manufacture, positive and durable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
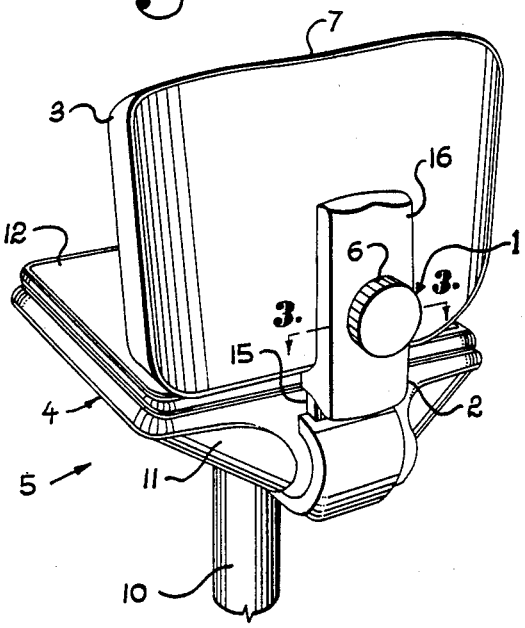
FIG. 1 is a fragmentary perspective view of a chair incorporating the chair back adjustment mechanism according to the present invention and shows the chair back assembly in a lowered position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a chair back height adjustment mechanism according to the present invention. The mechanism 1 is operable to extend a post assembly 2 to thereby vary the height of a backrest or chair back member 3 in relation to a chair base assembly 4 of an adjustable chair 5. In general, the height of the chair back member 3 can only be varied by rotation of a chair back height adjustment knob or dial 6. Because of the configuration of the mechanism 1, the height of the chair back member 3 cannot be changed by a downward force applied to the top surface 7 of the chair back member 3.

Figure 2:
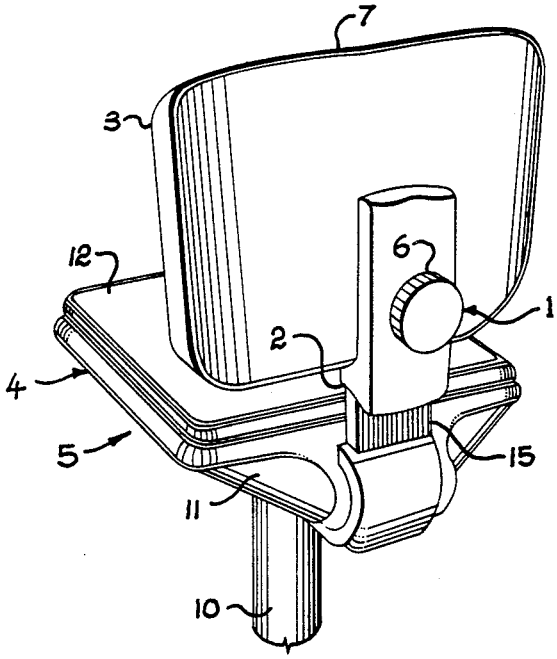
FIG. 2 is a view similar to FIG. 1 and shows the chair back assembly in a raised position.

Referring to FIGS. 1 and 2, the chair 5 is an office type chair which may be either an executive type chair with arms (not shown) or a secretarial type chair as illustrated. The chair base assembly 4 includes a chair pedestal 10 upstanding from a caster platform or spider (not shown), a seat frame 11 attached to the pedestal 10, and a seat cushion 12 positioned on the seat frame 11. The post assembly 2 is pivotally connected to the seat frame 11 and is resiliently urged toward an upright position. The manner of connection of the post assembly 2 to the seat frame 11 forms no part of the present invention and, therefore, is not described further herein.

Figure 3:
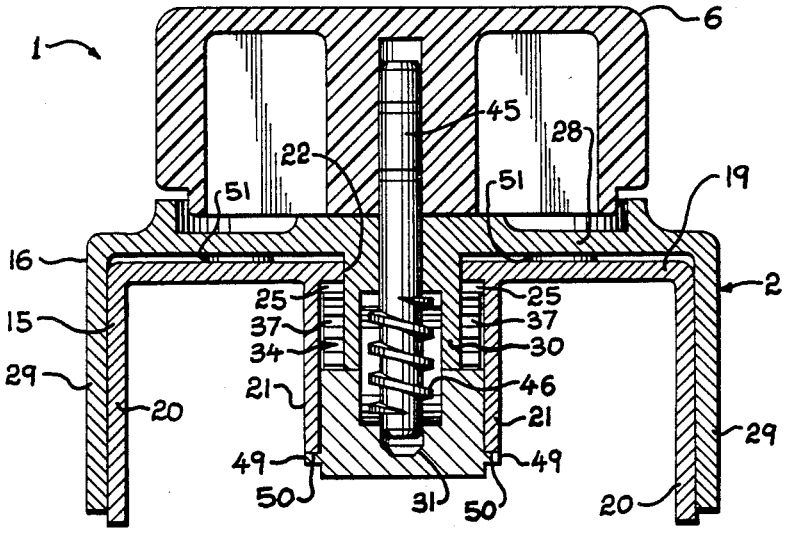
FIG. 3 is a greatly enlarged, horizontal sectional view of the chair back support post taken on line 3—3 of FIG. 1 and illustrates details of the adjustment mechanism.
Figure 4:
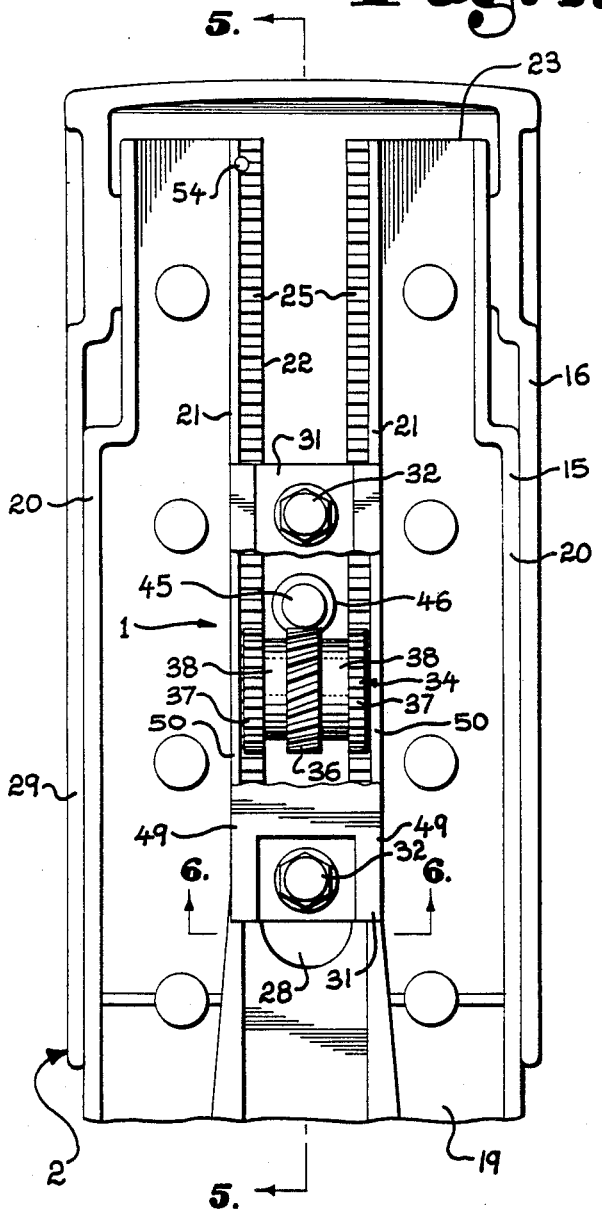
FIG. 4 is an enlarged, fragmentary front elevational view of the chair back post with the chair back member removed to illustrate details of the adjustment mechanism.
Figure 5:
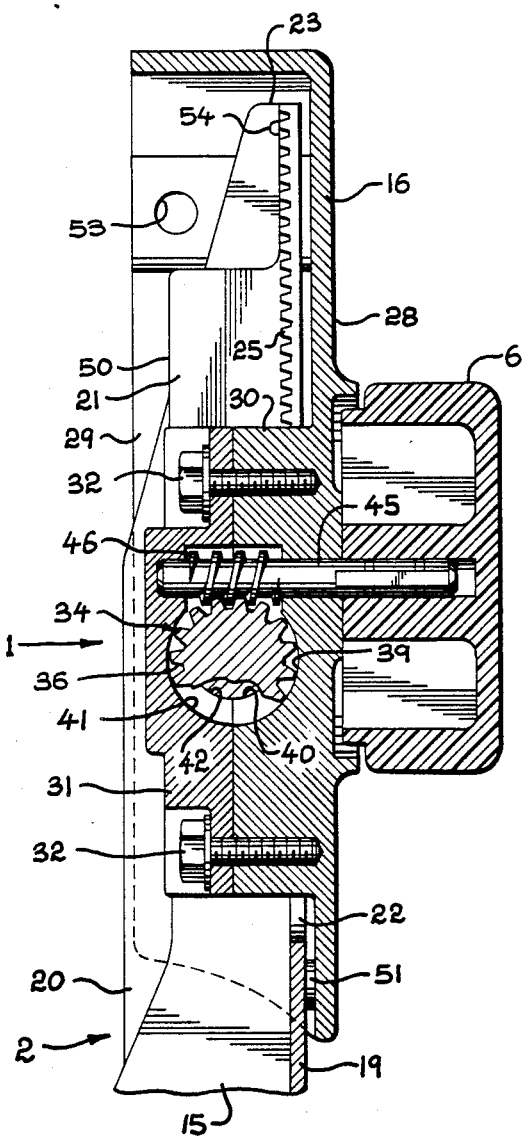
FIG. 5 is an enlarged, fragmentary vertical sectional view of the chair back post taken on line 5—5 of FIG. 4 and illustrates further details of the adjustment mechanism.
Figure 6:
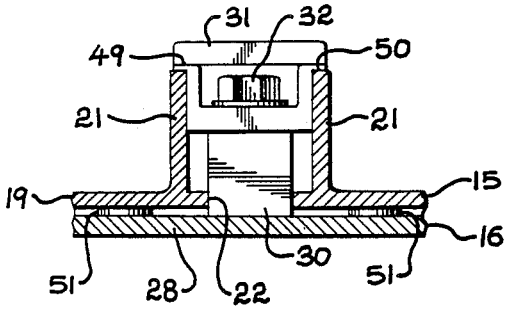
FIG. 6 is an enlarged, fragmentary horizontal sectional view taken on line 6—6 of FIG. 4 and illustrates further details of the mechanism according to the present invention.

The post assembly 2 includes a chair back support standard 15 which is pivotally connected to the seat frame 11 and a chair back support bracket 16 which is telescoped or slidably received on the standard 15. The bracket 16 has the chair back member 3 attached thereto. The illustrated standard 15 and bracket 16 are generally channel shaped, and the standard 15 is positioned within the bracket 16 (see FIG. 3). The adjustment mechanism 1 is engaged between the standard 15 and bracket 16 and controls the relative positions thereof.

Referring to FIGS. 3–6, the channel shaped standard 15 includes a rear web 19, flanges 20, and ribs 21 projecting forwardly from a central region of the web 19. An elongated slot 22 is formed near a top end 23 of the standard 15. A pair of rack gears 25 are formed along and on opposite edges of the slot 22. The channel shaped bracket 16 includes a rear web 28 and flanges 29 projecting forwardly therefrom. A gear bearing block 30 projects from a central portion of the bracket 16 and is positioned to fit into the slot 22 of the standard 15. The block 30 may be attached to the bracket 16 or may be cast as an integral part thereof. A gear retainer block 31 is attached to the block 30 as by bolts 32. The bearing block 30 and gear retainer 31 cooperate to rotatably mount a gear member 34.

The gear member 34 is generally cylindrical in shape and has teeth forming a worm wheel or worm gear portion 36 cut about a central region thereof. Teeth forming pinion gear portions 37 are cut about regions at the ends of the gear member 34 on opposite sides of the worm gear portion 36. Outward or convex cylindrical gear bearing surfaces 38 (FIG. 4) are formed between the worm gear portion 36 and the pinion gear portions 37. The bearing block 30 has half cylindrical recesses 39 formed therein to receive the gear portions 36 and 37. Inward or concave half cylindrical bearing surfaces 40 are formed between the recesses 39 and contact the bearing surfaces 38 of the gear member 34. Similarly, the gear retainer 31 has half cylindrical recesses 41 and inward or concave half cylindrical bearing surfaces 42 which mate with corresponding formations on the bearing block 30.

The gear member 34 is positioned between the bearing block 30 and the gear retainer 31 and with the pinion gear portions 37 in meshing engagement with the rack gears 25. A control shaft 45 is rotatably mounted in bores in the block 30 and retainer 31. The shaft 45 has worm threads 46 formed on one end thereof which mesh with the worm gear portion 36 of the gear member 34. The chair back height adjustment knob 6 is pressed onto the other end of the control shaft 45. Rotation of the knob 6 rotates the gear member 34 whereby the pinion gear portions 37 ascend or descend the rack gears 25 such that the bracket 16 is translated in relation to the standard 15. The bracket 16 is retained on the standard 15 by sliding contact between side edge flanges 49 of the gear retainer 31 and front surfaces 50 of the ribs 21 of the standard 15. Sliding engagement between the standard 15 and the bracket 16 is facilitated by slide bearing pads 51 positioned on the front side of the web 28 of the bracket 16. The pads 51 are preferably formed of a non-stick type material such as Teflon. The chair back member 3 is attached to the bracket 16 by means of fasteners (not shown) which pass through a pair of aligned apertures 53 in the flanges 29 of the bracket 16 and mating apertures (not shown) in the chair back member 3. Preferably, a means is provided to prevent the gear member 34 from being driven off the rack gears 25, such as the stop pin 54 illustrated in FIGS. 4 and 5.

In operation, the height of the chair back member 3 is adjusted simply by rotation of the knob 6 until the desired position is reached. Because the worm threads 46 can rotate the gear member 34 but not vice versa, the adjusted position of the chair back member 3 is not affected by a force on the top end 7 thereof. The mechanical advantage provided by the mechanism 1 is determined by the radius of the gear member 34, the pitch of the worm threads 46, and the radius of the knob 6. The knob 6 could incorporate a folding crank handle (not shown) to further facilitate operation of the adjustment mechanism 1.

While the mechanism 1 has been described and illustrated as having the rack gears 25 on the standard 15 and the gear member 34 on the bracket 16, the configuration could be reversed and still be encompassed by the spirit of the present invention. With the gear member and worm shaft on the standard, the rack gears on the bracket, and the slot in the bracket, the arrangement would lend itself well to replacement of the knob with an electric motor which would be mounted on the standard also. Such an adaptation might be a useful adjustment arrangement for use by handicapped or disabled persons. Additionally, the mechanism 1 has been described and illustrated as incorporating a pair of rack gears 25 and a pair of pinion gear portions 37. However, the present invention is also meant to encompass an arrangement similar to the mechanism 1 which employs a single rack and pinion gear set.

It is to be understood that while certain forms of the present invention have been illustrated and described herein, it is not to be limited to the specific forms or arrangement of parts described and shown.

What is claimed and desired to be secured by letters patent is as follows:

1. A chair structure comprising:

(a) chair base means including a chair seat and chair leg means;

(b) a single telescoping chair back support post assembly including an elongated standard extending upwardly from said chair base means and an elongated chair back support bracket having a chair back member attached thereto;

(c) one of said standard and said bracket being an inner post member and the other being an outer post member, said inner post member being slidably received within said outer post member;

(d) a slot formed along said inner post member;

(e) a rack gear formed along said slot within said inner post member;

(f) gear bearing means positioned within said outer post member and extending through said slot into said inner post member;

(g) a gear member rotatably supported in said gear bearing means within said inner post member, said gear member having a pinion gear portion meshed with said rack gear and having a worm gear portion;

(h) a chair back adjustment shaft rotatably supported on said outer post member and extending through said gear bearing means, said shaft including a manually operable knob at a first end and including a second end positioned within said inner post member; and (i) worm threads formed on said second end of said shaft and meshed with said worm gear portion of said gear member whereby rotation of said knob rotates said gear member to translate said bracket in relation to said standard thereby varying the height of said chair back.

2. A structure as set forth in claim 1 wherein:

(a) each of said standard and said bracket is channel shaped in cross section.

3. A structure as set forth in claim 2 wherein:

(a) said standard is said inner post member; and (b) said bracket is said outer post member.

4. A structure as set forth in claim 1 wherein:

(a) said inner post member includes a pair of ribs having end surfaces and extending along said slot within said inner post member; and (b) said gear bearing means includes laterally extending flanges spaced from said outer post member which slidably engage said end surfaces of said ribs.

5. A structure as set forth in claim 1 wherein:

(a) a pair of rack gears are formed respectively on opposite edges of said slot; and (b) said gear member includes a pair of pinion gear portions formed on opposite sides of said worm gear portion.

6. A chair structure comprising:

(a) a chair base including chair leg means supporting a chair seat;

(b) an elongated, channel shaped chair back support standard extending upwardly from said chair base;

(c) an elongated, channel shaped chair back support bracket slidably supported on said standard;

(d) a chair back member attached to said bracket;

(e) a pair of ribs having end surfaces and extending along and within said standard;

(f) a slot formed along and between said ribs;

(g) a rack gear positioned on one side of and along said slot within said standard;

(h) a gear bearing block positioned on said bracket, including a first concave half cylindrical bearing surface, and extending through said slot into said standard;

(i) a gear retainer block having a side flanges and a second concave half cylindrical bearing surface, said retainer block being attached to said bearing block such that said flanges slidably engage said end surfaces of said ribs to slidably support said bracket on said standard;

(j) a gear member having a pinion gear portion and a worm gear portion separated by a cylindrical gear bearing surface, said gear member being positioned between said bearing block and said retainer block within said standard with said gear bearing surface engaging said first and second concave bearing surfaces and said pinion gear portion meshing with said rack gear;

(k) a chair back adjustment shaft rotatably supported on said bracket and extending through said bearing block, said shaft including a manually operable knob at a first end and including a second end positioned within said standard; and (l) worm threads formed on said second end of said shaft and meshed with said worm gear portion of said gear member whereby rotation of said knob rotates said gear member to translate said bracket in relation to said standard thereby varying the height of said chair back.

* * * * *